US007085355B1

(12) United States Patent
Albagli et al.

(10) Patent No.: US 7,085,355 B1
(45) Date of Patent: Aug. 1, 2006

(54) SYSTEMS, METHODS, AND APPARATUS OF A COLLIMATOR

(75) Inventors: Douglas Albagli, Clifton Park, NY (US); Ping Xue, Cottage Grove, WI (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 11/125,548

(22) Filed: May 10, 2005

(51) Int. Cl.
*G21K 1/04* (2006.01)
*G21K 1/02* (2006.01)

(52) U.S. Cl. ..... 378/150; 378/147

(58) Field of Classification Search ..... 378/119, 378/145–160
See application file for complete search history.

(56) References Cited

U.S. PATENT DOCUMENTS 5,369,678 A * 11/1994 Chiu et al. ..... 378/62
6,968,042 B1 * 11/2005 Toth et al. ..... 378/156
2003/0016790 A1 * 1/2003 Grodzins et al. ..... 378/147

* cited by examiner

*Primary Examiner*—Edward J. Glick
*Assistant Examiner*—Irakli Kiknadze
(74) *Attorney, Agent, or Firm*—Carl Morton; Peter Vogel; Michael Smith

(57) ABSTRACT

Systems, methods and apparatus are provided through which a collimator has one or more varying physical characteristics that have the effect of varying the absorption of electromagnetic energy from a low extent of absorption at a leading edge to the same extent of absorption as the remainder of the collimator. In some embodiments, the collimator has a tapered knife-edge. The varying absorption of electromagnetic energy at different points along the collimator reduce abrupt transitions of projection of the electromagnetic energy onto an electromagnetic energy detector, thereby reducing erroneous artifacts in an image generated by the detector.

21 Claims, 9 Drawing Sheets

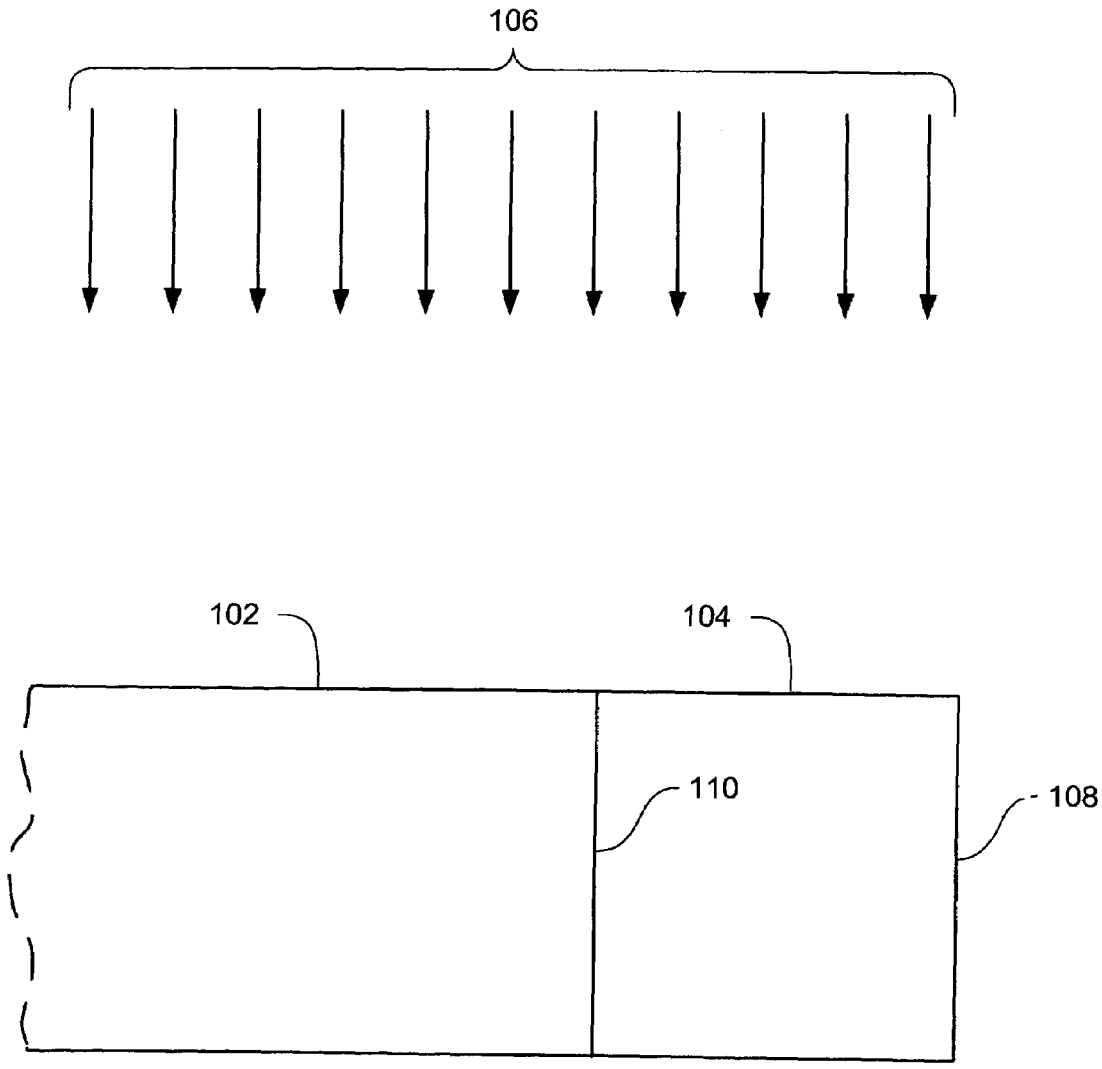
FIG. 1
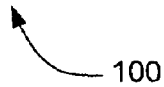

700

800

SYSTEMS, METHODS, AND APPARATUS OF A COLLIMATOR

FIELD OF THE INVENTION

This invention relates generally to projection of electromagnetic energy, and more particularly to collimators of projection of the electromagnetic energy.

BACKGROUND OF THE INVENTION

A collimator shapes and/or blocks electromagnetic energy projected from an X-Ray source. The collimator restricts electromagnetic energy to a size that is smaller than or equal to an active area of an X-Ray detector upon which the electromagnetic energy is projected. Collimation is useful in one example, to eliminate X-Ray irradiation of a part of a patient's anatomy which does not need to be imaged but may fall on the active area of the detector.

A part of an X-Ray collimator that attenuates the X-Ray projection is typically fabricated from an element with a high atomic number, such as lead or tungsten. The attenuating part typically has a blunt profile. The X-Ray projection on the detector may have a very sharp and abrupt transition from the area attenuated by the collimator which provides near complete blocking of the X-Ray, at a near zero signal level, to the area that is not attenuated by the collimator. In particular, the lack of attenuation is particularly stark in areas where there is no patient anatomy to attenuate the X-Ray projection.

The sharp and abrupt transition in the radiation field incident upon the detector sometimes produces image artifacts in subsequent images. For example, in X-Ray detectors that use Thallium-doped Cesium-Iodide as the scintillator, the scintillation efficiency may be temporarily modified by the intensity of the incident X-Ray irradiation. Efficiency may be varied or changed across the collimator edge due to the gradiant of the incident X-Ray irradiation. When a subsequent X-Ray image is taken in a manner where the patient anatomy has been re-positioned over the effected region, the temporary change in the scintillation efficiency will cause an unwanted transition in the signal level across the boundary where the collimator was previously imaged. If this change in signal level (contrast) is greater than some fraction of the background image noise, this transition will be visible as an artifact. The artifacts typically are nuisance lines in the image that in the worst situations, obscure portions of anatomy that are diseased or injured. The obscuration can cause medical misdiagnosis or mistreatment of the anatomy.

Artifacts can occur in angioradiography applications, radiography extremity applications, and mammoradiography applications with high doses of X-Ray energy and with different sizes of collimation.

One conventional technique of correcting the artifacts is through a correction process in image-processing of the X-Ray system. However, the software-based correction requires considerable financial resources to develop and maintain.

For the reasons stated above, and for other reasons stated below which will become apparent to those skilled in the art upon reading and understanding the present specification, there is a need in the art for a means to reduce artifacts in images that are caused by abrupt transitions in the strength of a projection of electromagnetic energy between areas of the projection, without use of software-base correction of the artifacts.

BRIEF DESCRIPTION OF THE INVENTION

The above-mentioned shortcomings, disadvantages and problems are addressed herein, which will be understood by reading and studying the following specification.

Systems, methods and apparatus are provided through which a collimator has one or more varying physical characteristics that have the effect of varying the absorption of electromagnetic energy from a low extent of absorption at a leading edge to the same extent of absorption as the remainder of the collimator. In some embodiments, the collimator has a tapered knife-edge. The varying absorption of electromagnetic energy at different points along the collimator reduce abrupt transitions of projection of the electromagnetic energy onto an electromagnetic energy detector, thereby reducing erroneous artifacts in an image generated by the detector.

In one aspect, an apparatus to collimate an electromagnetic projection includes a collimator blade and an edge having at least one physical property of varying ability to absorb electromagnetic energy, the edge being attached to the collimator blade. In some embodiments, the edge has a tapered shape. In some embodiments, the edge has a varying composition of materials of different atomic weights. In some embodiments, the edge has a varying density.

In another aspect, an apparatus to collimate an electromagnetic projection includes a collimator blade, and an edge having a tapered shape, the edge consisting of a material, and the material having about uniform density throughout the edge, the edge being formed as part of the collimator blade.

In yet another aspect, an apparatus to limit a cross section of an X-Ray beam includes a source of the X-Ray beam and a collimator having a tapered edge.

Apparatus, systems, and methods of varying scope are described herein. In addition to the aspects and advantages described in this summary, further aspects and advantages will become apparent by reference to the drawings and by reading the detailed description that follows.

BRIEF DESCRIPTION OF THE DRAWINGS

FIG. 1 is a cross section block diagram that provides an overview of an electromagnetic energy collimator to reduce artifacts in an image projected in conjunction with the collimator;

DETAILED DESCRIPTION OF THE INVENTION

Figure 2:
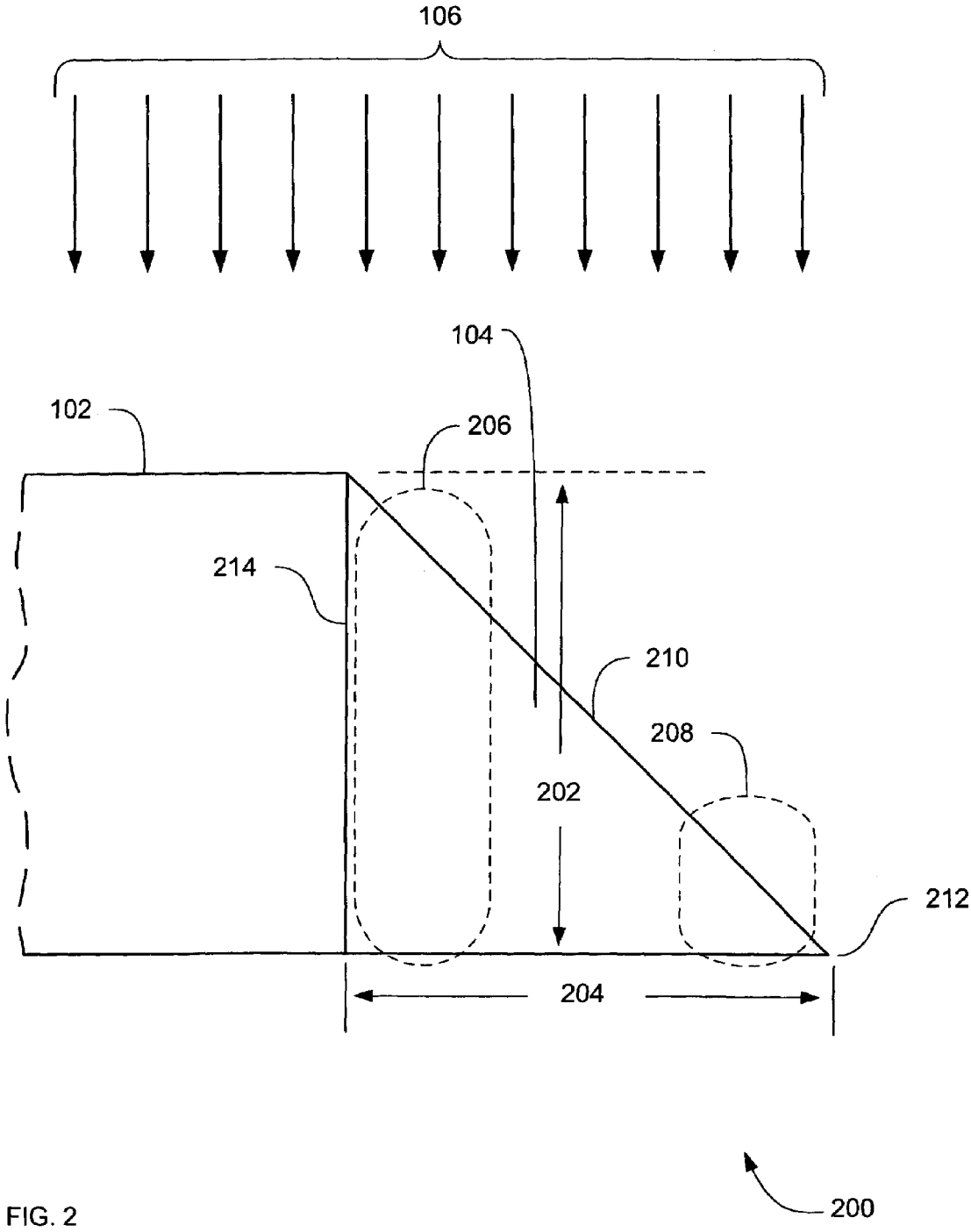
FIG. 2 is a cross section diagram of apparatus according to an embodiment in which a shape of the edge varies over a distance in order to vary attenuation of an electromagnetic signal over the distance.

In the following detailed description, reference is made to the accompanying drawings that form a part hereof, and in which is shown by way of illustration specific embodiments which may be practiced. These embodiments are described in sufficient detail to enable those skilled in the art to practice the embodiments, and it is to be understood that other embodiments may be utilized and that logical, mechanical, electrical and other changes may be made without departing from the scope of the embodiments. The following detailed description is, therefore, not to be taken in a limiting sense.

The detailed description is divided into five sections. In the first section, a system level overview is described. In the second section, apparatus of embodiments are described. Finally, in the third section, a conclusion of the detailed description is provided.

System Level Overview

FIG. 1 is a cross section block diagram that provides an overview of an electromagnetic energy collimator 100 to reduce artifacts in an image projected in conjunction with the collimator. System 100 solves the need in the art to reduce image artifacts. In system 100, over a given dimension of an edge of the collimator, an amount of absorbed electromagnetic energy varies, and that physical properties of the edge provide the variation.

System 100 includes a collimator blade 102. System 100 also includes an edge 104. The edge 104 has one or more physical properties of varying ability to absorb or conversely block, a particular frequency or a particular range of frequencies of electromagnetic energy 106.

The physical abilities vary over space, but not time. The physical properties vary from a lesser amount of blocking electromagnetic energy 106 at an outer boundary 108 of the edge 104, to a greater amount of blocking at an interface 110 between the collimator blade 102 and the edge 104. Thus, the edge 104 provides increasing levels of blocking from the outer boundary 108 to the collimator blade 102. The increasing levels of electromagnetic blocking in turn provides for a less noticeable, if not completely unnoticeable, transition in attenuation from the outer boundary 108 to the collimator blade 102. The less noticeable transition in attenuation reduces, if not excludes, erroneous and distracting artifacts in an image generated from a projection of the electromagnetic energy 106 onto an image detector. Thus, system 100 solves the need in the art to reduce image artifacts.

The edge 104 can be referred to as an electromagnetic transitional edge. The collimator blade 102 and the edge 104 are not necessarily separate components, but in some embodiments are manufactured from a singular component with separately identifiable portions of the collimator blade and the edge 104. While the system 100 is not limited to any particular collimator blade 102, edge 104, electromagnetic energy 106, outer boundary 108, and interface 110 for sake of clarity a simplified collimator blade 102, edge 104, electromagnetic energy 106, outer boundary 108 and interface 110 are described.

Apparatus of an Embodiment

In the previous section, a system level overview of the operation of an embodiment was described. In this section, the particular apparatus of such an embodiment are described by reference to a series of diagrams.

FIG. 2 is a cross section diagram of apparatus 200 according to an embodiment in which at least one dimension of a shape of the edge varies over a distance in order to vary attenuation of an electromagnetic signal over the distance. More specifically, the shape is tapered and monotonic. FIG. 2 is enlarged in comparison to FIG. 1 in order to show more detail of the edge. Apparatus 200 solves the need in the art to reduce image artifacts.

Apparatus 200 includes an edge 104 in which a physical property of shape varies. The varying shape causes the amount of an electromagnetic signal that passes through the edge to vary in direct proportion to the shape.

More specifically, in the embodiment shown in apparatus 200, a thickness 202 of the edge varies over a distance 204. The varying thickness 202 varies the extent that electromagnetic energy is absorbed or blocked by the edge 104. The thickness of thicker regions 206 of the edge 104 is greater than the thickness of the thinner portions 208 of the edge 104. In particular, the thickness 106 of a leading edge 212 of the edge 106 is less than the thickness of an interior edge 214. In addition, the electromagnetic absorbing properties of a material of which the edge 104 is composed is about uniform throughout the edge. Thus, the edge 104 blocks or absorbs the electromagnetic energy 106 at any given point (not shown) along the distance 204 in direct proportion to the thickness of the edge 104 at that point. Accordingly, the thicker regions 206 of the edge 104 block or absorb a greater amount of the electromagnetic energy 106 than the thinner portions 208 of the edge 104.

In some embodiments, the distance 204 is in a range of 0.5 millimeters (mm) to 2.0 mm. In some embodiments, the distance 205 is adjustable. The distance can be determined by system X-Ray source to imager distance (SID) and raw exposure level. Materials of which the edge 104 is composed include tungsten, steel, lead, magnesium, cooper and aluminum.

The straight-line tapered geometry of a face 210 of the edge 104 provides for a consistent straight-line tapered gradiation in the electromagnetic blocking characteristics of edge 104 along distance 204.

Figure 3:
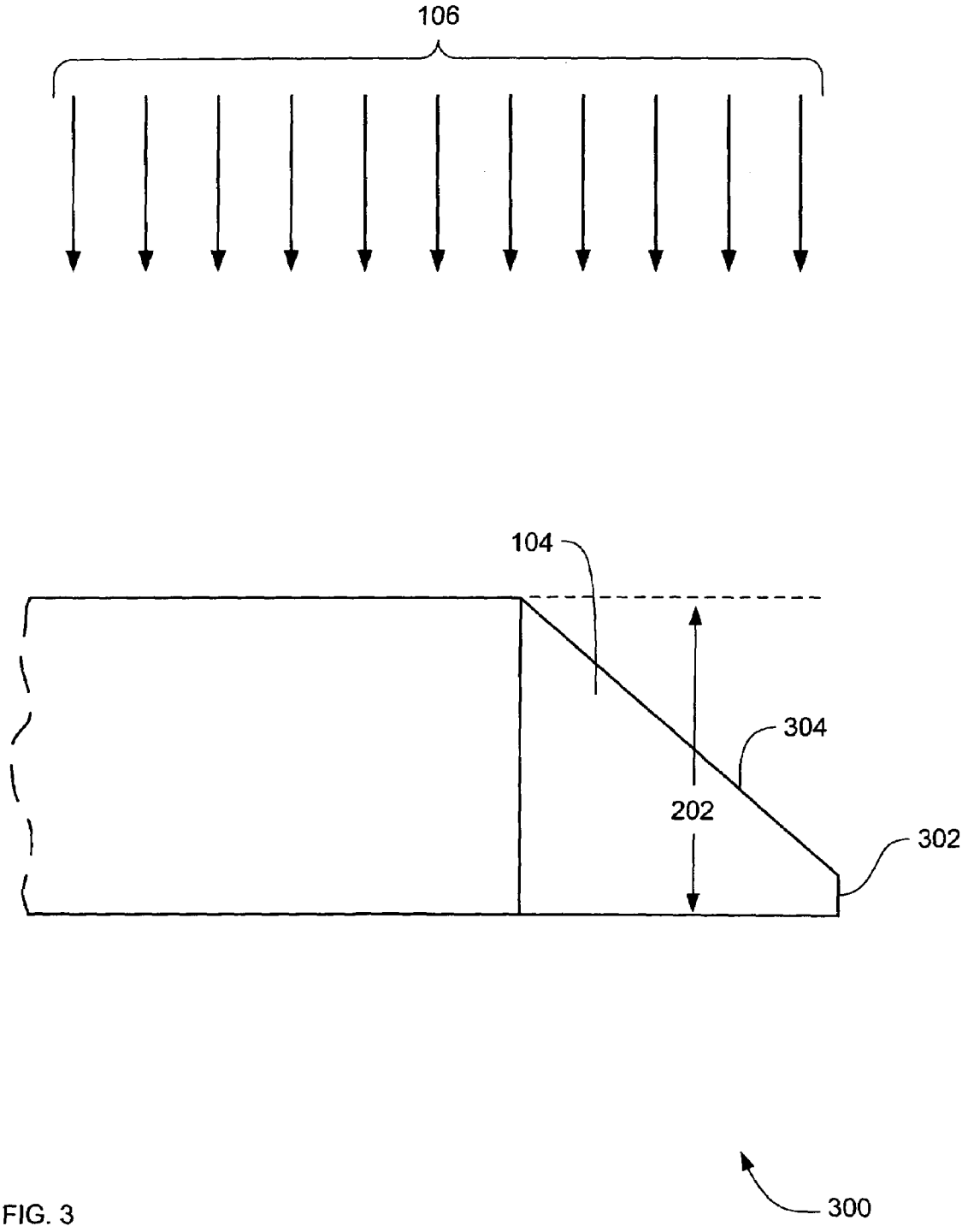
FIG. 3 is a diagram of apparatus according to an embodiment in which a partially-squared monotonic shape of the edge varies over a distance in order to vary attenuation of an electromagnetic signal over the distance.

FIG. 3 is a diagram of apparatus 300 according to an embodiment in which a partially-squared monotonic shape of the edge varies over a distance in order to vary attenuation of an electromagnetic signal over the distance. Apparatus 300 solves the need in the art to reduce image artifacts.

Apparatus 300 includes a partially-squared edge 104. In contrast to the knife-edge shaped leading edge 212 of the edge 104, the partially-squared edge 104 includes a face 302 that is perpendicular to a longitudinal axis (not shown) of the apparatus 300. The perpendicular face 302 is at a square angle to the longitudinal axis, and the square angle provides a partially-squared edge. The face 302 is joined by another tapered face 304. In the embodiment shown in apparatus 300, the length of the face 302 is about 10% of the thickness of the collimator. In other embodiment, the length of the face 302 is within a range of 1% to 99% of the thickness of the collimator.

Figure 4:
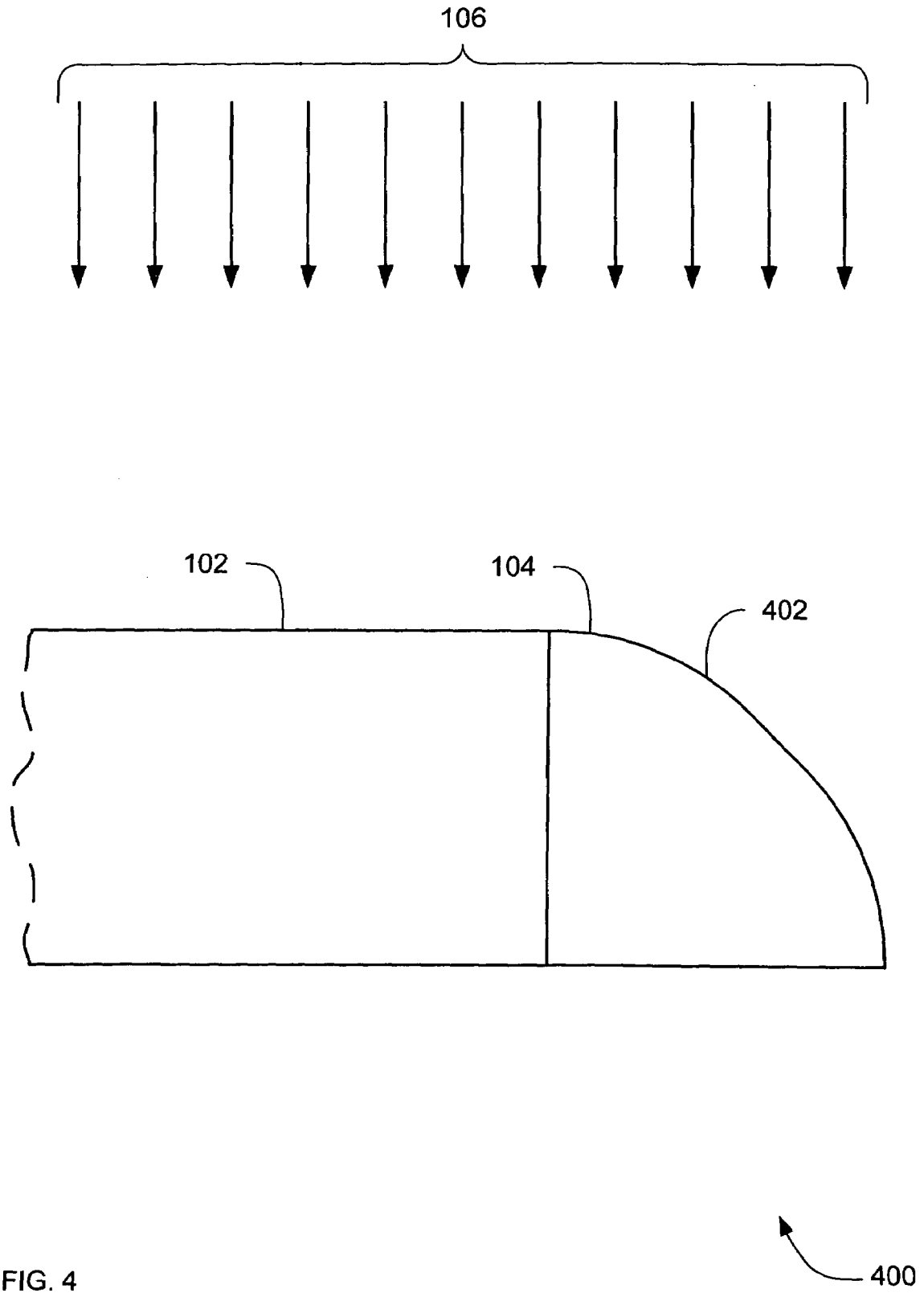
FIG. 4 is a diagram of apparatus according to an embodiment in which the edge has a rounded shaped.

FIG. 4 is a diagram of apparatus 400 according to an embodiment in which the edge 104 has a rounded shaped. Apparatus 400 includes an edge 104 with a rounded geometry in a face 402. The rounded geometry of the face 402 in some embodiments is an elliptical shape, a circular shape or as shown, an oblong shape. The rounded geometry of the face 402 in some embodiments is a concave shape, or as shown a convex shape.

Figure 5:
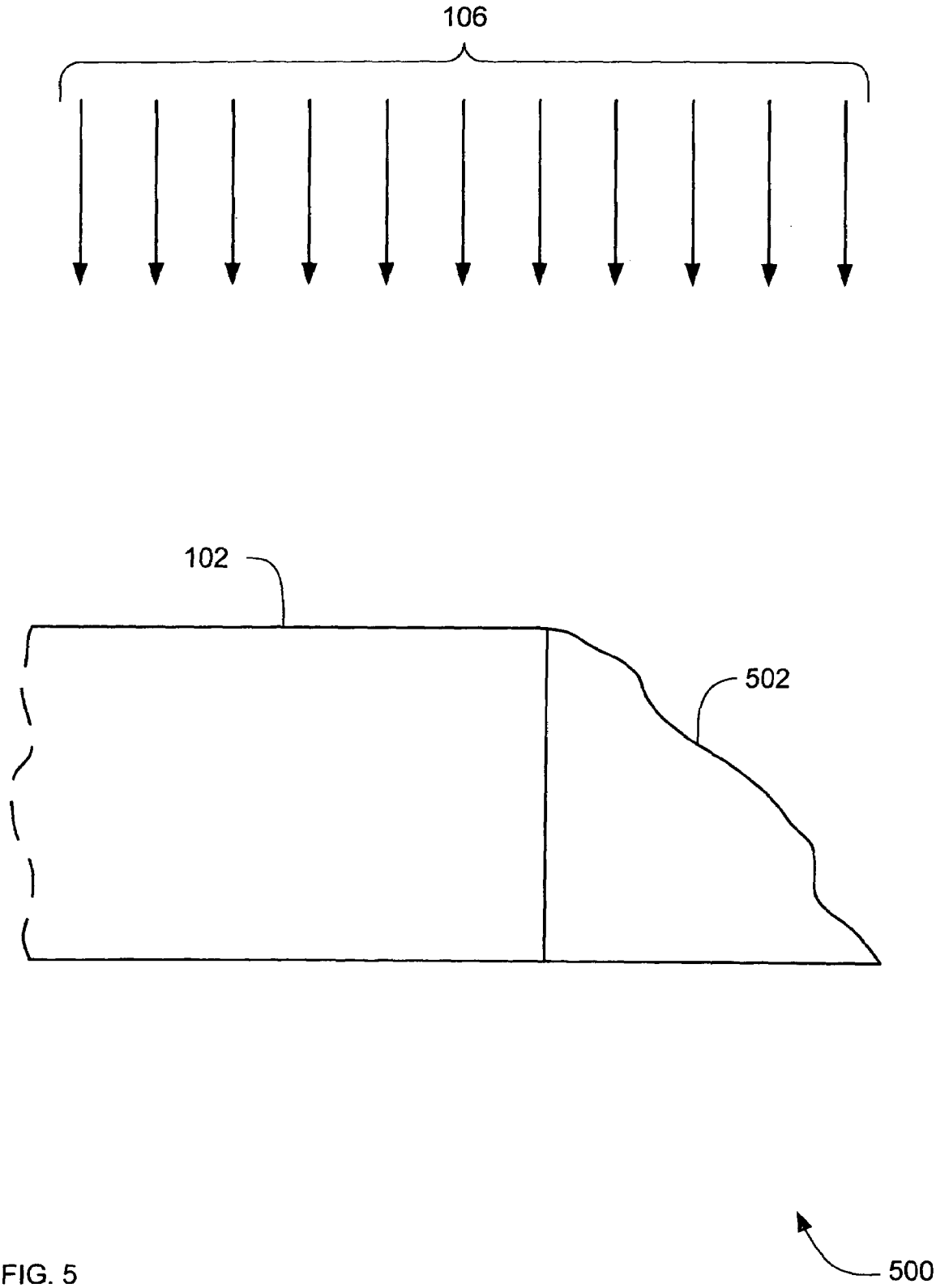
FIG. 5 is a diagram of apparatus according to an embodiment in which the edge has an irregular shape.

FIG. 5 is a diagram of apparatus 400 according to an embodiment in which the edge 104 has an irregular shape. Apparatus 400 includes an edge 102 with an irregular geometry in a face 502.

Figure 6:
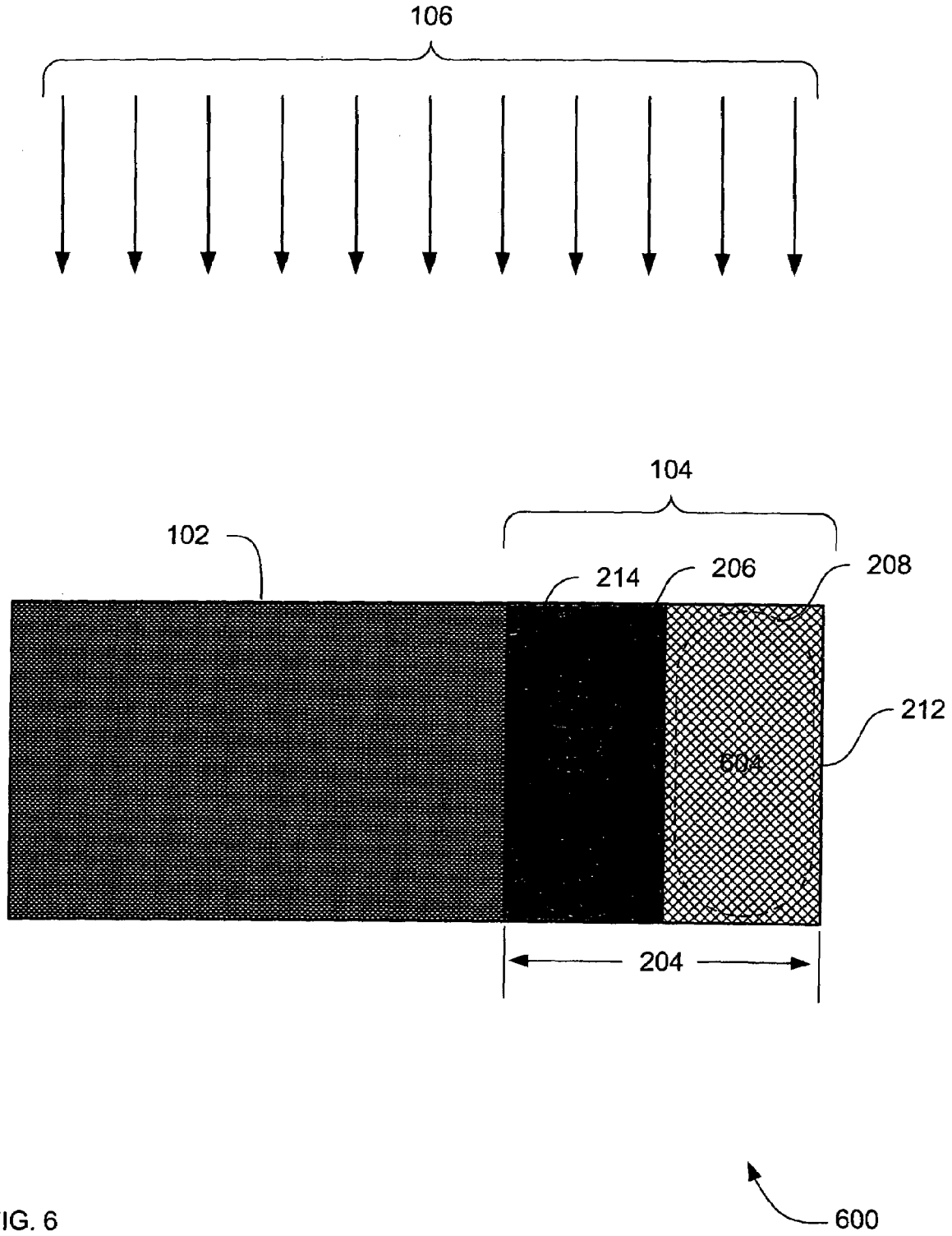
FIG. 6 is a cross section diagram of apparatus according to an embodiment in which a composition of the edge varies over a distance in order to vary attenuation of an electromagnetic signal over the distance.

FIG. 6 is a cross section diagram of apparatus 600 according to an embodiment in which a composition of the edge varies over a distance in order to vary attenuation of an electromagnetic signal over the distance. Apparatus 600 solves the need in the art to reduce image artifacts.

Apparatus 600 includes an edge 104 in which the composition of materials varies. The varying composition of the materials causes the amount of an electromagnetic signal that passes through the edge to vary in direct proportion to the variation in the ability of the materials to absorb or block the electromagnetic energy 106. In apparatus 600, the position of the materials is arranged in order from the material having the highest atomic weight being closest to the collimator blade, and the material having the lowest atomic weight being furthest from the collimator blade.

More specifically, in the embodiment shown in apparatus 600, the atomic weight of the material of collimator blade 102 is greater than the atomic weight of the material 602 in the edge 104, which is greater than the atomic weight of material 604 in the edge 104. For example, the material of the collimator blade 102 is lead, the material 602 is tungsten, and the material 604 is copper. The varying atomic weight of materials 602 and 604 varies the extent that electromagnetic energy is absorbed or blocked by the edge 104. In particular, the atomic weight of material 604 of the leading edge 212 of the edge 104 is less than the atomic weight of the interior edge 214. In addition, the electromagnetic absorbing properties of materials 602 and 604 of which the edge 104 is composed is about uniform throughout for each material. Thus, the edge 104 blocks or absorbs the electromagnetic energy 106 at any given point (not shown) along the distance 204 in direct proportion to the atomic weight of the material of the edge 104 at that point. Accordingly, the region 206 of the edge 104 blocks or absorbs a greater amount of the electromagnetic energy 106 than the thinner portions 208 of the edge 104.

Apparatus 600 shows edge 104 being composed of two materials 602 and 604. However, other embodiments that are not shown have an edge 104 with a greater number of a plurality of materials.

Figure 7:
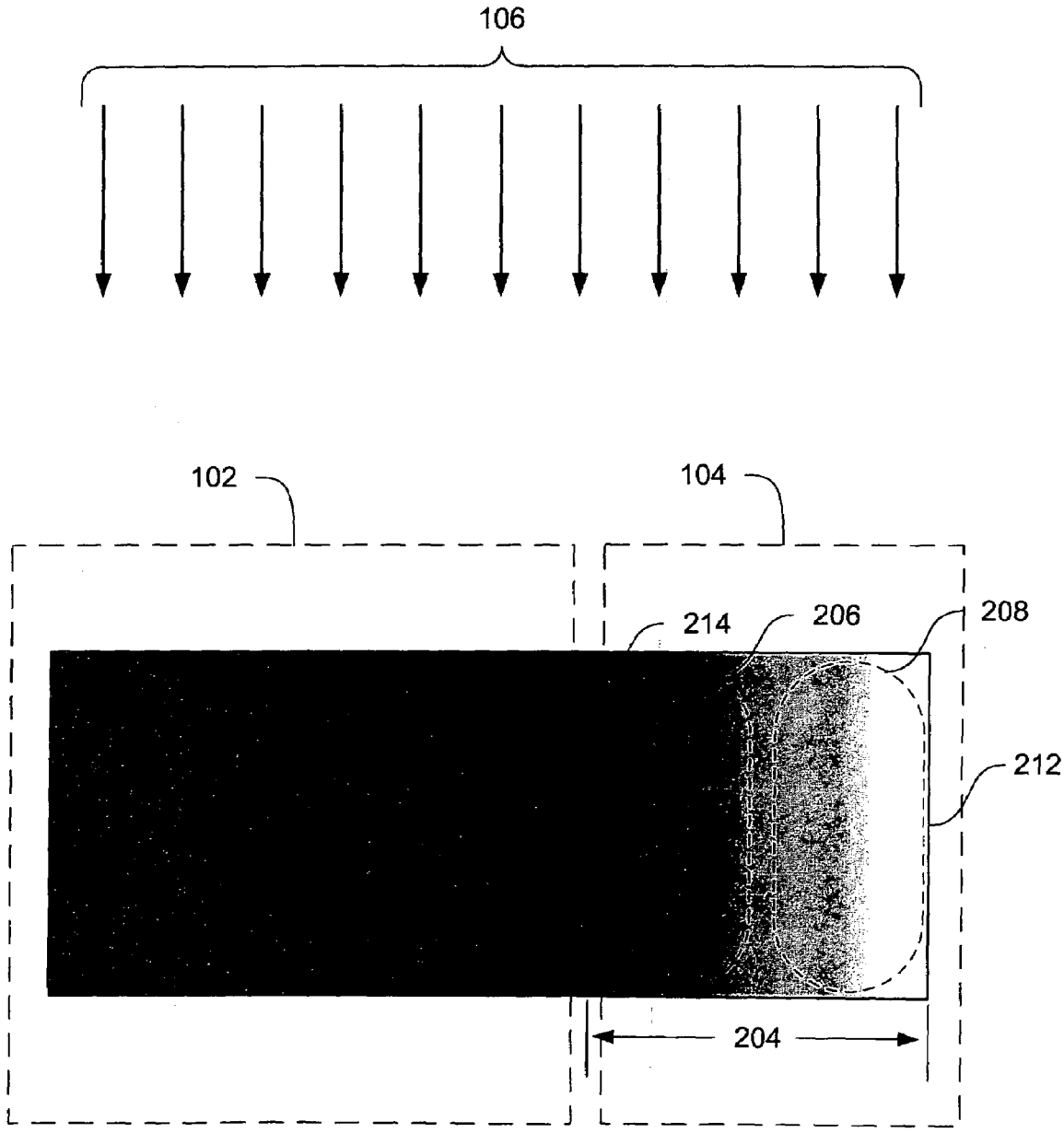
FIG. 7 is a cross section diagram of apparatus according to an embodiment in which a density of a material of the edge varies over a distance in order to vary attenuation of an electromagnetic signal over the distance.

FIG. 7 is a cross section diagram of apparatus 700 according to an embodiment in which a density of a material of the edge varies over a distance in order to vary attenuation of an electromagnetic signal over the distance. Apparatus 700 solves the need in the art to reduce image artifacts.

The varying density of the materials of the edge 104 causes the amount of an electromagnetic signal that passes through the edge to vary in direct proportion to the variation in the density of the material of the edge 104. Thus, the edge 104 blocks or absorbs the electromagnetic energy 106 at any given point (not shown) along the distance 204 in direct proportion to the density of the material of the edge 104 at that point. Accordingly, the region 206 of the edge 104 blocks or absorbs a greater amount of the electromagnetic energy 106 than the less dense portions 208 of the edge 104.

The variation of density is consistently less dense from interior edge 214 to leading 212, which provides for a consistent gradiation in the electromagnetic blocking characteristics of edge 104 along distance 204.

Figure 8:
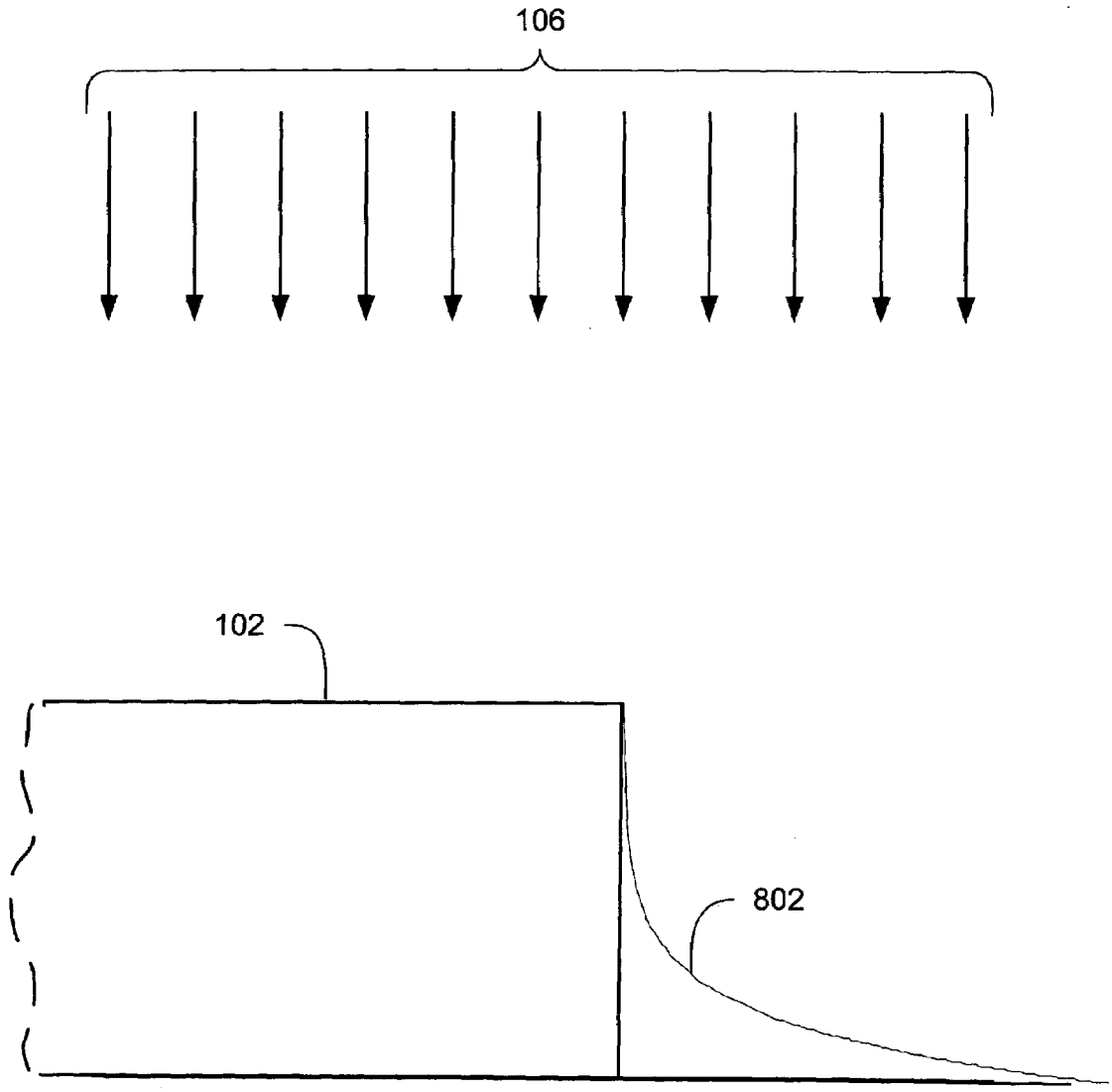
FIG. 8 is a diagram of apparatus according to an embodiment in which the edge has an variable shape so that the image signal across the edge uniformly decreases.

FIG. 8 is a diagram of apparatus 800 according to an embodiment in which the edge 104 has a variable shape so that the image signal across the edge uniformly decreases.

The cross section dimensions of edge 104 are described by formula 1:

$$s=s_{max}(\exp(-\mu t)) \qquad \text{formula 1}$$

In formula 1, s represents a signal, $s_{max}$ represents a maximum signal, μ represents an attenuation coefficient of the edge and t represents a thickness. In some embodiments, t is gradually decreased so that Δs/s is constant on a processed image, yielding curve 802.

Figure 9:
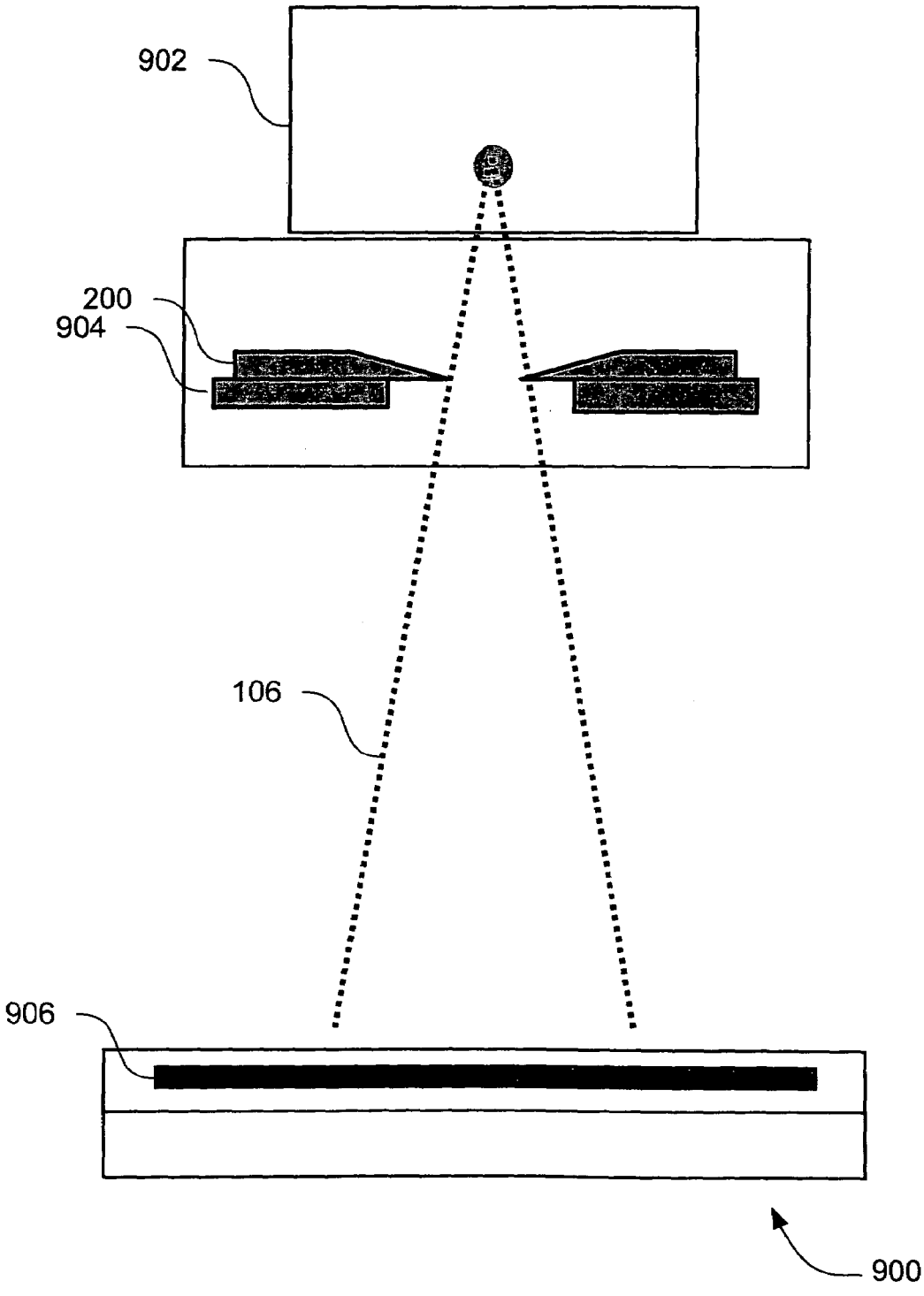
FIG. 9 is a diagram of medical X-Ray imaging system according to an embodiment having a collimator of one of more physical properties of varying ability to block an X-Ray projection.

FIG. 9 is a diagram of medical X-Ray imaging system 900 according to an embodiment having a collimator of one of more physical properties of varying ability to block an X-Ray projection. Apparatus 900 solves the need in the art to reduce image artifacts.

Apparatus 900 includes a medical X-Ray source 902 projecting X-Ray beam 106 and a conventional collimator 904. Apparatus 900 also includes a collimator 200 having a tapered edge. The purpose of using two collimator blade layers, 904 without a tapered edge and 200 with tapered edge, is to control either one of the collimator blades. For example, a taper collimation is not used at low x-ray exposure or the collimator field of view fully opened to cover an entire imaging area. A taper collimation is required when imaging at high exposure and collimator field of view opened within the imaging area. Collimators 200 and 904 can also be combined as one when taper collimation is applied to all cases of the imaging field of view. That is, some implementations include one blade with a tapered edge; or two blades, one with tapered edge and one without a tapered edge. Both blades are controlled separately depending on application conditions.

In other embodiments, apparatus 900 includes collimator 100, collimator 300, collimator 400, collimator 500, collimator 700 or collimator 900 in place of collimator 200. Collimator 200 collimates the projected X-Ray beam 106 and a X-Ray detector 906 detects the collimated X-Ray beam. In some embodiments, the X-Ray detector 906 is a digital X-Ray detector. In some embodiments, the X-Ray detector 906 is a film-based X-Ray detector.

CONCLUSION

An X-Ray Collimator with a tapered edge cross section is described. Although specific embodiments are illustrated and described herein, it will be appreciated by those of ordinary skill in the art that any arrangement which is calculated to achieve the same purpose may be substituted for the specific embodiments shown. This application is intended to cover any adaptations or variations. One of ordinary skill in the art will appreciate that implementations can be made in a number of equivalents that provide the required function.

In particular, one of skill in the art will readily appreciate that the names of the methods and apparatus are not intended to limit embodiments. Furthermore, additional methods and apparatus can be added to the components, functions can be rearranged among the components, and new components to correspond to future enhancements and physical devices used in embodiments can be introduced without departing from the scope of embodiments. One of skill in the art will readily recognize that embodiments are applicable to future electromagnetic sources, different collimators and new electromagnetic detectors.

The terminology used in this application is meant to include all environments and alternate technologies which provide the same functionality as described herein.

We claim:

1. An apparatus to collimate an electromagnetic projection, the apparatus comprising:

a collimator blade; and an edge having at least one physical property of varying ability to absorb electromagnetic energy, the edge being attached to the collimator blade;

wherein cross section dimensions of the edge are described by a formula s=smax (exp(−μt)) wherein, s represents a signal, smax represents a maximum signal, μ represents an attenuation coefficient of the edge, and t represents a thickness of the edge.

2. The apparatus of claim 1, wherein the at least one physical property of varying ability to absorb electromagnetic energy further comprises:

a tapered shape.

3. The apparatus of claim 2, wherein the at least one physical property of varying ability to absorb electromagnetic energy further comprises:

a partially-squared tapered shape.

4. The apparatus of claim 1, wherein the at least one physical property of varying ability to absorb electromagnetic energy further comprises:

a knife-edged shape.

5. The apparatus of claim 1, wherein the at least one physical property of varying ability to absorb electromagnetic energy further comprises:

a varying composition of material in the edge.

6. The apparatus of claim 1, wherein the at least one physical property of varying ability to absorb electromagnetic energy further comprises:

a plurality of materials having unequal atomic weights, in which the position of the materials is arranged in order from the material having the highest atomic weight being closest to the collimator blade, and the material having the lowest atomic weight being furthest from the collimator blade.

7. The apparatus of claim 6, wherein the plurality of materials further comprise:

two materials.

8. The apparatus of claim 1, wherein the at least one physical property of varying ability to absorb electromagnetic energy further comprises:

a varying density of material in the edge.

9. The apparatus of claim 1, wherein the at least one physical property of varying ability to absorb electromagnetic energy further comprises:

a varying dimension of a shape of the edge.

10. An apparatus to collimate an electromagnetic projection, the apparatus comprising:

a collimator blade; and an edge having a tapered shape, the edge consisting of a material, and the material having about uniform density throughout the edge, the edge being formed as part of the collimator blade;

wherein cross section dimensions of the edge are described by a formula s=smax (exp(−μt)) wherein, s represents a signal, smax represents a maximum signal, μ represents an attenuation coefficient of the edge, and t represents a thickness of the edge.

11. The apparatus of claim 10, wherein the tapered shape further comprises:

a knife-edge tapered shape.

12. The apparatus of claim 10, wherein the tapered shape further comprises:

a partially-squared tapered shape.

13. An apparatus to collimate an electromagnetic projection, the apparatus comprising:

an electromagnetic source; and a collimator having a tapered edge, the collimator being attached to the electromagnetic source;

wherein cross section dimensions of the edge are described by a formula s=smax (exp(−μt)) wherein, S represents a signal, smax represents a maximum signal, μ represents an attenuation coefficient of the edge, and t represents a thickness of the edge.

14. The apparatus of claim 13, wherein the thickness of a leading edge is less than the thickness of an interior edge.

15. The apparatus of claim 14, wherein the thickness of the collimator at the leading edge of the collimator is about 10% of the thickness of the collimator at an interior position.

16. The apparatus of claim 13, wherein the tapered edge further comprises:

a knife edge at the leading edge of the collimator.

17. An apparatus to limit a cross section of an X-Ray beam, the apparatus comprising:

a source of the X-Ray beam; and a collimator having a tapered edge;

wherein cross section dimensions of the tapered edge are described by a formula s=smax (exp(−μt)) wherein, s represents a signal, smax represents a maximum signal, μ represents an attenuation coefficient of the edge, and t represents a thickness of the edge.

18. The apparatus of claim 17, wherein the tapered edge further comprises:

a thinner thickness at the inside edge of the collimator than at an interior position of the collimator.

19. The apparatus of claim 17, wherein the tapered edge further comprises:

a knife edge at the inside edge of the collimator.

20. A medical X-Ray imaging system, the apparatus comprising:

a source operable to project a medical X-Ray; and a collimator having an leading edge and an interior edge, the leading edge having a thickness that is less than a thickness of the interior edge;

wherein cross section dimensions of the edge are described by a formula s=smax (exp(−μt)) wherein, s represents a signal, smax represents a maximum signal, μ represents an attenuation coefficient of the edge, and t represents a thickness of the edge.

21. The medical X-Ray imaging system of claim 20, the collimator further comprising:

a tapered knife-edge shape.

* * * * *